US010323310B2

(12) United States Patent
Johns

(10) Patent No.: US 10,323,310 B2
(45) Date of Patent: Jun. 18, 2019

(54) PROCESS FOR MAKING FINISHED OR SEMI-FINISHED ARTICLES OF SILVER ALLOY

(71) Applicant: Peter Gamon Johns, Watford (GB)

(72) Inventor: Peter Gamon Johns, Watford (GB)

( * ) Notice: Subject to any disclaimer, the term of this patent is extended or adjusted under 35 U.S.C. 154(b) by 557 days.

(21) Appl. No.: 14/884,885

(22) Filed: Oct. 16, 2015

(65) Prior Publication Data

US 2016/0032436 A1 Feb. 4, 2016

Related U.S. Application Data

(63) Continuation of application No. 12/830,612, filed on Jul. 6, 2010, now Pat. No. 9,222,150, which is a continuation-in-part of application No. 11/628,260, filed as application No. PCT/GB2005/050074 on May 27, 2005, now abandoned, said application No. 12/830,612 is a continuation-in-part of application No. 11/942,827, filed as application No. PCT/GB2006/050116 on May 19, 2006, now abandoned.

(30) Foreign Application Priority Data

| | | |
|---|---|---|
| Jun. 2, 2004 | (GB) | 0412256.0 |
| Sep. 23, 2004 | (GB) | 0421172.8 |
| May 20, 2005 | (GB) | 0510243.9 |
| Nov. 11, 2005 | (GB) | 0523002.4 |

(51) Int. Cl.

| | |
|---|---|
| ***C22F 1/14*** | (2006.01) |
| ***C22C 5/06*** | (2006.01) |
| ***C22C 5/08*** | (2006.01) |
| ***B22D 21/02*** | (2006.01) |

(52) U.S. Cl.

CPC ..... *C22F 1/14* (2013.01); *B22D 21/027* (2013.01); *C22C 5/06* (2013.01); *C22C 5/08* (2013.01)

(58) Field of Classification Search

CPC ..... C22F 1/14; C22C 5/06; C22C 5/08
See application file for complete search history.

(56) References Cited

U.S. PATENT DOCUMENTS

| | | | | |
|---|---|---|---|---|
| 4,124,380 | A * | 11/1978 | Youdelis | C22C 5/06 420/502 |
| 4,392,289 | A * | 7/1983 | Michaud | A44C 17/046 164/10 |
| 6,168,071 | B1 * | 1/2001 | Johns | B23K 35/3006 148/430 |
| 9,222,150 | B2 * | 12/2015 | Johns | C22C 5/08 |
| 2004/0236203 | A1 * | 11/2004 | Salvo | A61B 18/14 600/396 |
| 2006/0045792 | A1 * | 3/2006 | Agarwal | C22C 5/08 420/504 |

FOREIGN PATENT DOCUMENTS

| | | | | |
|---|---|---|---|---|
| WO | WO-9514112 | A1 * | 5/1995 | C22C 5/08 |
| WO | WO-9622400 | A1 * | 7/1996 | C22C 5/08 |
| WO | WO-02095082 | A2 * | 11/2002 | C22F 1/02 |

OTHER PUBLICATIONS

C.D. Coxe, A.S. McDonald, G.H. Sistare, Jr., A.M. Reti, Properties of Precious Metals, Properties and Selection: Nonferrous Alloys and Special-Purpose Materials, vol. 2, ASM Handbook, ASM International, 1990, pp. 699-719 (print version), pp. 1-5 (online version). (Year: 1990).*

L. L. Karpov, Quenching in a Stream of Compressed Gases, Metallovedenie i Termicheskaya Obrabotka Metallov, No. 7, Jul. 1966, pp. 59-62 (original), pp. 581-583 (translated version). (Year: 1966).*

A. Reti, Silver: Alloying, Properties and Applications, Encyclopedia of Materials: Science and Technology, Elsevier Science, 2001, pp. 8618-8621 (print version), pp. 1-4 (online version). (Year: 2001).*

* cited by examiner

*Primary Examiner* — Scott R Kastler
*Assistant Examiner* — Vanessa T. Luk

(57) ABSTRACT

A process for making a finished or semi-finished article of silver alloy, said process comprising the steps of providing a silver alloy containing silver in an amount of at least 77 wt %, copper and an amount of germanium that is preferably at least 0.5 wt % and is effective to reduce tarnishing and/or firestain, making or processing the finished or semi-finished article of the alloy by heating at least to an annealing temperature, gradually cooling the article; and reheating the article to effect precipitation hardening thereof. The avoidance of quenching reduces the risk of damage to the article.

11 Claims, No Drawings

PROCESS FOR MAKING FINISHED OR SEMI-FINISHED ARTICLES OF SILVER ALLOY

REFERENCE TO PRIOR APPLICATIONS

This application is a continuation application of pending U.S. patent application Ser. No. 12/830,612, filed 6 Jul. 2010, which is a continuation-in-part application of U.S. patent application Ser. No. 11/628,260 filed 1 Dec. 2006 which is a 371 of International patent application PCT/GB2005/050074 filed 27 May 2005 (Publication No. WO 2005/118903) which claims priority from UK Patent Application 04 21172.8 filed 23 Sep. 2004 and UK Patent Application 04 12256.0 filed 2 Jun. 2004. It is also a continuation in part of U.S. patent application Ser. No. 11/942,827 filed 20 Nov. 2007 which is a 371 of International; patent application PCT/GB2006/050116 filed 19 May 2006 (International Publication No WO 2006/123190) which claims priority from UK Patent Application No. 05 23002,4 filed 11 Nov. 2005 and UK Patent Application No. 05 10243.9 filed 20 May 2005. The disclosure of each application is hereby incorporated by reference in its entirety where appropriate for teachings of additional or alternative details, features or technical background, and priority is asserted from each.

FIELD OF THE INVENTION

The present invention relates to a process for making finished or semi-finished articles of silver alloy and to articles made by the above process.

BACKGROUND TO THE INVENTION

Molten silver and copper are completely soluble in each other in all proportions. However, alloys which have copper contents ranging from about 2% through 27%, when solidified and examined under a microscope, exhibit two discrete constituents: one is nearly 100% silver; the other is a silver-copper "eutectic" (71.9% silver; 28.1% copper), whose melting point is 1435° F. (780° C.). When standard sterling silver is cooled, microscopic analysis shows both of the above constituents to be present in the solidified sterling. The alloy is entirely liquid at 1640° F. (890° C.) and entirely solid at 1435° F. (780° C.) However, the degree of copper solubility in the solid alloy depends on the heat treatment used, and the overall physical properties of the sterling can be materially affected, not only by heating the silver to different temperatures, but also by employing different cooling rates.

Silver alloys are normally supplied soft for easy working. Heat treatment can be used to increase hardness (and decrease ductility). The process, known as precipitation hardening involves heating and cooling the silver in such a way as to cause copper to precipitate out of solid solution, thereby producing a fine binary structure. This type of structure is hard, but it is also difficult to work, and has a tendency to crack. Precipitation hardening of conventional sterling silver can be achieved by (a) heating the alloy to or above 775° C., (b) holding the alloy at that temperature for 15-30 minutes for annealing thereof (i.e. dissolving all the copper in the silver), (c) quenching rapidly in cold water, which prevents formation of Cu-rich coarse precipitates which are ineffective in bringing about hardening, (d) re-hardening the softened alloy by heating to e.g. 300° C. for 30-60 minutes resulting in the formation of very tine Cu-rich particles which are effective in bringing about hardening and (e) air cooling. The annealing temperatures involved are very high and are close to the onset of melting. Furthermore, there are very few times in practical production that a silversmith can safely quench a piece of nearly finished work because of the risk of distortion of the article being made and/or damage to soldered joints. Silversmiths therefore regard precipitation hardening of sterling silver as of metallurical interest only. It is too difficult for commercial or industrial production of articles of jewelry, silver plate, hollowware, and the like (see Fischer-Buhner, "An Update on Hardening of Sterling Silver Alloys by Heat Treatment", Proceedings, Santa Fe Symposium on Jewellery Manufacturing Technology, 2003, 20-47 at p. 29) and it is unnecessary because sterling silver as produced generally has hardness of 70 Vickers or above. Alloys of higher Vickers hardness are obtained by work hardening rather than precipitation hardening. Furthermore, in investment casting, it is impractical for the manufacture of silver rings and other jewelry by stone in place casting where there is a significant risk that the stone will not survive annealing and quenching.

It has been alleged by Aldo Reti, Encyclopaedai of Materials, Science and Technology that:

"As cast, sterling silver (7.5 wt % Cu) has a silver-rich primary solid solution and some non-equilibrium eutectic. As wrought, with conventional 590-620° C. anneals, it has a silver matrix (containing little copper) with laminated copper particles (containing little silver). Sterling silver may be precipitation hardened by dissolving the copper at 745° C. and precipitating it at 310° C. and it may be hardened appreciably by annealing at 695-745° C. and air cooling. If a handle is torch brazed to a pitcher and the pitcher is air cooled the annealed brazed areas will harden; if a fork is annealed at 670-700° C. it will harden on air cooling. Air cooling is convenient and sterling silver is very soft in a furnace at its solution temperature."

In the example given by Reti, the pitcher and handle would have been torch annealed between the forming/shaping processes. A brazing test was therefore conducted by the inventor on traditional sterling silver sheet (7.5 wt % Cu) that had been initially torch annealed to replicate Reti's example. Soldering to the sheet was with an easy solder/brazing alloy melting range 705-720° C. and flux was placed on a pickled surface of the sheet prior to soldering which was carried out using a gas/air torch. Hardness levels were measured on a Vickers Hardness machine at CATRA (Cutlery and Allied Trades Research Association) in Sheffield, England. Results were as follows:

| | Hardness Measurements HV 2½ kg | | | | | Average hardness |
|---|---|---|---|---|---|---|
| Sample | 1 | 2 | 3 | 4 | 5 | HV |
| 1. | 67.0 | 66.5 | 67.5 | 66.5 | 64.5 | 66.4 |
| 2. | 59.6 | 57.9 | 59.1 | 60.4 | 58.7 | 59.1 |
| 3. | 61.8 | 65.0 | 65.0 | 65.0 | 64.1 | 64.2 |

1. As-received (annealed by manufacturer);
2. Torch annealed and air cooled;
3. Torch annealed, air cooled, brazed with Easy soldering/brazing alloy and air cooled.

The sheet that had been torch annealed and air cooled had a slightly greater hardness than the sheet annealed by the manufacturer. There was no appreciable hardening response of the torch annealed traditional sterling silver sheet after brazing—the measured hardness did not exceed that of commercially available sheet in the annealed condition. The precipitation hardening alleged by Reti was not observed, and the present result is in accordance with common general knowledge amongst silversmiths i.e. that standard sterling does not precipitation harden under these conditions.

Patent GB-B-2255348 (Rateau, Albert and Johns; Metaleurop Recherche) discloses a novel silver alloy that maintains the properties of hardness and lustre inherent in Ag—Cu alloys while reducing problems resulting from the tendency of the copper content to oxidise. The alloys are ternary Ag—Cu—Ge alloys containing at least 92.5 wt % Ag. 0.5-3 wt % Ge and the balance, apart from impurities, copper. The alloys are stainless in ambient air during conventional production, transformation and finishing operations, are easily deformable when cold, easily brazed and do not give rise to significant shrinkage on casting. They also exhibit superior ductility and tensile strength. Germanium was stated to exert a protective function that was responsible for the advantageous combination of properties exhibited by the new alloys, and was in solid solution in both the silver and the copper phases. The microstructure of the alloy was said to be constituted by two phases, a solid solution of germanium and copper in silver surrounded by a filamentous solid solution of germanium and silver in copper which itself contains a few intermetallic CuGe phase dispersoids. The germanium in the copper-rich phase was said to inhibit surface oxidation of that phase by forming a thin GeO and/or $GeO_2$ protective coating which prevented the appearance of firestain during brazing and flame annealing. Furthermore the development of tarnish was appreciably delayed by the addition of germanium, the surface turned slightly yellow rather than black and tarnish products were easily removed by ordinary tap water. It is explained that increased hardness can be developed by de-tensioning the alloy e.g. by heating to 500° C. and then heating the alloy to a "low annealing" temperature below 400° C. e.g. to 200° for 2 hours to give a Vickers hardness of about 140. However, there is no suggestion that such hardness can be achieved without the steps of heating to an annealing temperature followed by quenching, and therefore there is also no suggestion that the increased hardness can be achieved in nearly finished work.

U.S. Pat. No. 6,168,071 and EP-B-0729398 (Johns) disclosed a silver/germanium alloy which comprised a silver content of at least 77 wt % and a germanium content of between 0.4 and 7%, the remainder principally being copper apart from any impurities, which alloy contained elemental boron as a grain refiner at a concentration of greater than 0 ppm and less than 20 ppm. The boron content of the alloy could be achieved by providing the boron in a master copper/boron alloy having 2 wt % elemental boron. It was reported that such low concentrations of boron surprisingly provided excellent grain refining in a silver/germanium alloy, imparting greater strength and ductility to the alloy compared with a silver/germanium alloy without boron. The boron in the alloy inhibited grain growth even at temperatures used in the jewelry trade for soldering, and samples of the alloy were reported to have resisted pitting even upon heating repeatedly to temperatures where in conventional alloys the copper/germanium eutectic in the alloy would melt. Strong and aesthetically pleasing, joints between separate elements of the alloy could be obtained without using a filler material between the free surfaces of the two elements and a butt or lap joint could be formed by a diffusion process or resistance or laser welding techniques. Compared to a weld in Sterling silver, a weld in the above-described alloy had a much smaller average grain size that improved the formability and ductility of the welds, and an 830 alloy had been welded by plasma welding and polished without the need for grinding. Again there is no disclosure or suggestion that precipitation hardening can be achieved safely in nearly finished work.

Argentium (Trade Mark) sterling comprises Ag 92.5 wt % and Ge 1.2 wt %, the balance being copper and about 4 ppm boron as grain refiner. The Society of American Silversmiths maintains a website for commercial embodiments of the above-mentioned alloys known as Argentium (Trade Mark) at the web address hup://www.silversmithing.com/largentium.htm. it discloses that Argentium Sterling is precipitation hardenable (i.e. by heating to an annealing temperature and quenching), that a doubling in final hardness can be achieved by reheating at temperatures obtainable in a domestic oven e.g. 450° F. (232° C.) for about 2 hours or 570° F. (299° C.) for about 30 minutes. It further discloses that the hard alloy can be softened by conventional annealing (i.e. heating to an annealing temperature and quenching) and then hardened again if required. However, there is no suggestion that precipitation hardening is appropriate for nearly finished work and that the problems of distortion and damage to soldered joints can be avoided.

U.S. Pat. No. 6,726,877 (Eccles) discloses inter alia an allegedly fire scale resistant, work hardenable jewellery silver alloy composition comprising 81-95.409 wt % Ag. 0.5-6 wt % Cu, 0.05-5 wt % Zn, 0.02-2 wt % Si, 0.01-2 wt % by weight B. 0.01-1.5 wt % In and 0.01-no more than 2.0 wt % Ge. The germanium content is alleged to result in alloys having work hardening characteristics of a kind exhibited by conventional 0.925 silver alloys, together with the firestain resistance of allegedly firestain resistant alloys known prior to June 1994. Amounts of Ge in the alloy of from about 0.04 to 2.0 wt % are alleged to provide modified work hardening properties relative to alloys of the firestain resistant kind not including germanium, but the hardening performance is not. linear with increasing germanium nor is the hardening linear with degree of work. The Zn content of the alloy has a bearing on the colour of the alloy as well as functioning as a reducing agent for silver and copper oxides and is preferably 2.0-4.0 wt %. The Si content of the alloy is preferably adjusted relative to the proportion of Zn used and is preferably 0.15 to 0.2 wt %. Precipitation hardening following annealing, is not disclosed, and there is no disclosure or suggestion that the problems of distortion and damage to soldered joints in nearly finished work made of this alloy can be avoided.

By way of background, U.S. Pat. No. 4,810,308 (Leach & Garner) discloses a hardenable silver alloy comprising not less than 90% silver; not less than 2.0% copper; and at least one metal selected from the group consisting of lithium, tin and antimony. The silver alloy can also contain up to 0.5% by weight of bismuth. Preferably, the metals comprising the alloy are combined and heated to a temperature not less than 1250-1400° F. (676-760° C.) e.g. for about 2 hours to anneal the alloy into a solid solution, a. temperature of 1350° (732° C. being used in the Examples. The annealed alloy is then. quickly cooled to ambient temperature by quenching. it can then be age hardened. by reheating to 300-700° F. (149-371° C.) for a predetermined time followed by cooling of the age hardened alloy to ambient temperature. The age-hardened alloy demonstrates hardness substantially greater that that of traditional sterling silver, typically 100 HVN (Vickers Hardness Number), and can being returned by elevated temperatures to a relatively soft state. The disclosure of U.S. Pat. No. 4,869,757 (Leach & Garner) is similar, In both cases the disclosed annealing temperature is higher than that of Argentium, and neither reference discloses firestain or tarnish-resistant alloys. The inventor is not aware of the process disclosed in. these patents being used for commercial production, and again there is no disclosure or suggestion that hardening can be achieved in nearly finished work.

A silver alloy called Steralite is said to be covered by U.S. Pat. Nos. 0,581,7195 and 5.882,441 and to exhibit high tarnish and corrosion resistance, The alloy of U.S. Pat. No. 5,817.195 (Davitz) contains 90-92.5 wt % Ag, 5,75-5.5 wt % Zn, 0.25 to less than 1 wt % Cu, 0.25-0.5 wt % Ni, 0.1-0.25 wt % Si and 0.0-0.5 wt % In. The alloy of U.S. Pat. No. 5,882,441 (Davitz) contains 90-94 wt % Ag, 3.5-7.35 wt % Zn, 1-3 wt % Cu and 0.1-2.5 wt % Si. A similar high zinc low copper alloy is disclosed in U.S. Pat. No. 4,973,446 (Bernhard) and is said to exhibit reduced firestain, reduced porosity and reduced grain scale. None of these references discusses annealing or precipitation hardening.

SUMMARY OF THE INVENTION

We have found that Ag—Cu—Ge alloy workpieces either gradually cooled from melting temperature or heated to an annealing temperature and gradually cooled can then be hardened by mild reheating to effect precipitation hardening. In particular, an increase of 15 HV or more can be achieved, in embodiments 20 HV or more. compared to the hardness of the alloy at the end of gradual cooling (the Vickers scale has a margin of error of +−0.5 HV and an increase of at least 15 HV. preferably 20 HV is needed before that increase can be regarded as significant). Such significant improvements in hardness without the need for a preliminary quenching step were unexpected and are not disclosed in or suggested by any reference known to the applicants. Significantly it has been found that over-aging of Ag—Cu—Ge alloys during precipitation hardening does not cause a significant drop-off of the hardness achieved. The above process is based on a surprising difference in properties between conventional Sterling silver alloys and other Ag—Cu binary alloys on the one hand and Ag—Cu—Ge alloys on the other hand, in which gradual cooling of the binary Sterling-type alloys results in coarse precipitates and only limited precipitation hardening, whereas gradual cooling of Ag—Cu—Ge alloys results in fine precipitates and useful precipitation hardening, particularly where the alloy contains an effective amount of grain refiner. Gradual cooling includes the avoidance of any abrupt cooling step as when an article is plunged into water or other cooling liquid, and normally implies that cooling to ambient temperatures takes more than 10 seconds, preferably more than 15 seconds.

Furthermore, the addition of germanium to sterling silver changes the thermal conductivity of the silver alloy, compared to standard sterling silver. The International Annealed Copper Scale (IACS) is a measure of conductivity in metals. On this scale the value of copper is 100%, pure silver is 106%, and standard sterling silver 96%, while a sterling alloy containing 1.1% germanium has a conductivity of 56%. The significance of this difference in thermal conductivity is that the Argentium sterling and other germanium-containing silver alloys do not dissipate heat as quickly as standard sterling silver or their non-germanium-containing equivalents, a piece will take longer to cool, and precipitation hardening to a commercially useful level (e.g. to Vickers hardness 90 or above) can take place during natural air cooling or during slow controlled air cooling, the alloy then being further hardened e.g. to 120 HV or above by reheating at 180-350° C.

Control can be achieved during the mesh belt conveyor furnace treatment of workpieces to be brazed and/or annealed by gradual cooling as the workpiece is moved towards the discharge end of the furnace. Control can also be achieved during investment casting if the piece being cast is allowed to air-cool to ambient temperature, the rate of heat loss being moderated by the low conductivity investment material of the flask.

In order to distinguish the operations of annealing and precipitation hardening (which are regarded as distinct by silversmiths) annealing temperatures may be defined to be temperatures above 500° C., whereas precipitation hardening temperatures may be defined to be in the range 150° C.-400° C., the lower value of 150° C. permitting embodiments of the alloys of the invention to be precipitation hardened in a domestic oven. The use of reheating to e.g. 150-400° C., usually 180-350° C. and more usually 250-300° C. to develop precipitation hardness is typical.

Not having to quench to achieve the hardening affect is a major advantage of the present silver alloys. There are very few times in practical production that a silversmith can safely quench a piece of nearly finished work. The risk of distortion and damage to soldered joints when quenching from a high temperature would make the process not commercially viable. In fact, as explained above, standard sterling can also be precipitation hardened but only on subsequent quenching and this is one reason why precipitation hardening is not used for sterling silver.

The ability of the present silver alloys to precipitation harden enables the copper content of the alloy to be reduced. Even though an alloy of lower copper content may be relatively soft as cast, reheating at a low temperature e.g. 200-300° C. may bring the hardness up to the level of normal sterling silver or better. This is a significant advantage because the copper content is actually the most detrimental part of the alloy from the standpoint of corrosion resistance, but in a standard sterling alloy less copper means unacceptably low hardness. If the copper content is reduced, the silver content may simply be increased which is a preferred option. Other possibilities include increasing the germanium content or adding zinc or another alloying element.

Experimental evidence has also shown that Ag—Cu—Ge alloys of Ag content at least 92.5 wt % become precipitation hardened following cooling from a melting or annealing temperature by baking at e.g. 200° C.-400° C. even at copper contents at or below 3 wt %, e.g. below 1.7 wt %, e.g. below 1.5 wt % e.g.. below 1 wt % down to e.g. 0.5 wt %, and that baking the alloy can achieve a hardness of 65 or above, preferably 70 HV or above and still more preferably 75 HV or above which is equal to or above the hardness of standard sterling silver used to make jewelry and other silverware. These advantageous properties are believed to be the result of the combination of Cu and Ge in the silver alloy and are independent of the presence and amounts of Zn, In, Sn, Sb, Mn or other incidental alloying ingredients. Silver alloy of Ag 973 parts per thousand and containing about 1.0 wt % Ge, balance copper, has been successfully precipitation hardened by gradual air cooling from an annealing temperature followed by reheating. This behaviour contrasts with that of high silver low copper alloys not containing Ge which do not precipitation harden. Silver alloys of very low copper content can exhibit sweat resistance and can perform well in salt spray tests.

The new method of processing workpieces is applicable, for example as part of soldering or annealing in a mesh belt conveyor furnace or in investment casting, eliminates quenching e.g. with water which as explained above is required for Ag--Cu Sterling silver, and which as explained above can give rise to distortion or damage to the product, and therefore can be used for nearly finished work. The process is applicable to alloys of the general kind disclosed in GB-B-2255348. It is also believed to be applicable to some or all of the alloys disclosed in U.S. Pat. No. 6,726,877, including those of relatively high germanium content and also those of lesser germanium content and relatively high zinc and silicon content.

The present invention provides a process for making a finished or semi-finished article of silver alloy, said process comprising the steps of:

providing a silver alloy containing silver in an amount of at least 77 wt copper and an amount of germanium that is at least 0.5 wt % and is effective to reduce tarnishing and/or firestain;

making or processing the finished or semi-finished article of the alloy by heating at least to an annealing temperature;

gradually cooling the article to ambient temperatures; and reheating the article to effect precipitation hardening thereof, the reheating providing, an increase of hardness of at least 15 HV.

When applied to finished or semi-finished articles of the alloys disclosed in U.S. Pat. No. 6,726,877, said process comprises the steps of:

providing a silver alloy comprising at least 86 wt % Ag, 0,5-7.5 wt % Cu, 0.07-6 wt % by weight of a mixture of Zn and Si wherein said Si is present in an amount of from about 0.02 to about 2.0 wt %, and from about 0.01 to no more than 3.0 wt % by weight Ge (preferably no more than 2.0 wt % Ge).

making or processing the finished or semi-finished article of the alloy by heating at least to an annealing temperature;

gradually cooling the article; and reheating the article to effect precipitation hardening thereof.

The invention also provides a precipitation hardenable silver alloy comprising 96-97.3 wt % silver, 1-2 wt % germanium, optionally up to 1 wt % zinc, optionally up to 0.2 wt % silicon, the balance copper and 1-40 ppm boron as grain refiner. On gradual cooling and reheating to effect precipitation hardening an increase of hardness of at least 15 HV can be obtained. Such alloys may exhibit a hardness of >95 HV, e.g. >100 HV.

DESCRIPTION OF PREFERRED EMBODIMENTS

Alloys that May be Used in the Above Process

The alloys that may be treated according to the invention include an alloy of at least 77 wt % silver containing copper and an amount of germanium that is effective to reduce firestain and/or tarnishing. The inventor considers that 0.5 wt Ge provides a preferable lower limit and that in practice use of less than 1 wt % is undesirable, amounts of 1-1.5 wt % being preferred.

The ternary Ag—Cu—Ge alloys and quaternary Ag—Cu—Zn—Ge alloys that can suitably be treated by the method of the present invention are those having a silver content of preferably at least 80 wt %, and most preferably at least 92.5 wt %, up to a maximum of no more than 98 wt preferably no more than 97 wt %. The germanium content of the Ag—Cu—(Zn)—Ge alloys should be at least 0.5%, more preferably at least 1.1%, and most preferably at least 1.5%, by weight of the alloy, up to a maximum of preferably no more than 3%. Major alloying ingredients that may be used to replace copper in addition to zinc (e.g. in amounts of up to I wt % e.g. 0.5 wt %) are Au, Pd and Pt. Other alloying ingredients may be selected from selected from Al, Ba, Be, Cd, Co, Cr, Er, Ga, In, Mg, Mn, Ni, Ph Si, Sn, Ti, V, Y, Yb and Zr, provided the effect of germanium in terms of providing firestain and tarnish resistance is not unduly adversely affected. The weight ratio of germanium to incidental ingredient elements may range from 100:0 to 60:40, preferably from 100:0 to 80:20. In some current commercially available Ag—Cu—Ge alloys such as Argentium incidental ingredients are not added.

Silicon, in particular, may be added to silver alloys e.g. in an amount of up to 0.5 wt %, typically 0.05-0.3 wt %, more usually 0.1-0.2 wt %, and is conveniently provided in the form of a copper-silicon master alloy containing e.g. about 10 wt % Si. When incorporated e.g. into casting grain of a silver-copper-germanium ternary alloy it can provide investment castings that appear bright immediately on removal from the mould. it may be added to casting grain e.g. before investment casting or it may he incorporated into the silver at the time of first melting to form an alloy.

The remainder of the ternary Ag—Cu—Ge alloys, apart from impurities, incidental ingredients and any grain refiner, will be constituted by copper, which should be present in an amount of at least 0.5%, preferably at least 1%, more preferably at least 2%, and most preferably at least 4%, by weight of the alloy. For an '800 grade' ternary alloy, for example, a copper content of 18.5% is suitable. It has been found that without the presence of both copper and germanium, hardening upon re-heating may not be observed.

The remainder of a quaternary Ag—Cu—Zn—Ge alloys, apart from impurities and any grain refiner, will be constituted by copper which again should be present in an amount of at least 0.5%, preferably at least 1%, more preferably at least 2%, and most preferably at least 4%, by weight of the alloy, and zinc which should be present in a ratio, by weight, to the copper of no more than 1:1. Therefore, zinc is optionally present in the silver-copper alloys in an amount of from 0 to 100% by weight of the copper content. For an '800 grade' quaternary alloy, for example, a copper content of 10.5% and zinc content of 8% is suitable.

In addition to silver, copper and germanium, and optionally zinc, the alloys preferably contain a grain refiner to inhibit grain growth during processing of the alloy. Suitable grain refiners include boron, iridium, iron and nickel, with boron being particularly preferred. The grain refiner, preferably boron, may be present in the Ag—Cu—(Zn)—Ge alloys in the range from 1 ppm to 100 ppm, preferably from 2 ppm to 50 ppm, more preferably from 4 ppm to 20 ppm, by weight of the alloy and very typically in the case of boron 1-10 ppm, e.g. 4-7 ppm.

In a preferred embodiment, the alloy is a ternary alloy consisting, apart from impurities and any grain refiner, of 80% to 96% silver, 0.1% to 5% germanium and 1% to 19.9% copper, by weight of the alloy. In a more preferred embodiment, the alloy is a ternary alloy consisting, apart from impurities and grain refiner, of 92.5% to 98% silver, 0.3% to 3% germanium and 1% to 7.2% copper, by weight of the alloy, together with 1 ppm to 40 ppm boron as grain refiner. In a further preferred embodiment, the alloy is a ternary alloy consisting, apart from impurities and grain refiner, of 92.5% to 96% silver, 0.9% to 2% germanium, and 1% to 7% copper, by weight of the alloy, together with 1 ppm to 40 ppm boron as grain refiner. A particularly preferred ternary alloy which has been marketed under the name Argentium comprises comprises 92.5-92.7 wt % Ag, 6.1-6.3% Cu and about 1.2 wt % Ge, although more recent alloys have 93.5 wt % Ag, 1.2 wt % Ge and 5.3 wt % Cu.

As previously explained, the alloys disclosed in U.S. Pat. No. 6,726,877 comprise at least 86 wt % Ag, 0.5-7.5 wt %

Cu, 0.07-6 wt % by weight of a mixture of Zn and Si wherein said Si is present in an amount of from about 0.02 to about 2.0 wt %, and from about 0.01 to no more than 3.0 wt % by weight Ge, preferably no more than 2.0 wt % Ge. In some embodiments at least 92.5 wt % of silver is present, 2-4 wt % Cu may be present, 2-4 wt Zn is preferably present, 0.02-2 wt % Si is present and 0.04-3.0 wt % Ge is present. The alloys may also contain up to 3.5 wt % of at least one additive selected from the group consisting of In, B and a mixture of In and B. e.g. up to about 2 wt % B and up to 1.5 wt % In, and they may also contain 0.25-6 wt % Sn. One particular species of alloys comprises 81-95.409 wt % Ag, 0.5-6 wt % Cu, 0.05-5 wt % Zn, 0.02-2 wt % Si, 0.01-2 wt % B, 0.01-1.5 wt % In and 0.01-3 wt % Ge. A second species of alloy comprises 75-99.159 wt % Ag, 0.5-6 wt % Cu, 0.05-5 wt % Zn, 0.02-2 wt % Si, 0.01-2 wt % B, 0.01-1.5 wt % In, 0.25-6 wt % Sn and 0.01-3 wt % Ge.

High copper alloys according to WO9622400 (Eccles) may also be used, and these are based on 2-5-19.5 wt % Cu, 0.02-2 wt % Si, 0.01-3.3 wt % Ge, the balance being silver, incidental ingredients and impurities. Examples of such alloys comprise (a) 92.5 wt % Ag, 7.0 wt % Cu, 0.2 wt % Si and 0.3 wt Ge, (b) 92.5 wt Ag, 6.8 wt % Cu, 0.3 wt % Si and 0.2 wt % Ge and 0.2 wt % Sn, (c) 83.0 wt % Ag, 16.5 wt % Cu, 0.2 wt % Si and 0.3 wt % Ge. In the case of these alloys, the combination of the germanium and copper content is believed to give rise to an ability to harden on heating to an annealing, temperature, gradually air cooling and reheating under mild conditions to effect precipitation hardening.

Shaped or Fabricated Articles

In one embodiment the article is a shaped or fabricated article e.g. of jewellery, woven mesh or chain or mesh knitted from drawn wire, or of hollowware spun from sheet or tube made of the above alloy and is treated by heating to a soldering or annealing temperature by passage through a continuous mesh belt conveyor brazing or annealing furnace. Such conveyors are available from e.g. Lindberg, of Watertown, Wis., USA and Dynalab of Rochester N.Y. as mentioned above. Generally such articles will be a soldered or brazed assembly of two or more components.

When annealing, it is desirable that the furnace gas, although protective, should not deplete the surface layer of germanium, as this will reduce the tarnish resistance of the alloy and its resistance to firestain. Atmospheres may be of nitrogen, cracked ammonia (nitrogen and hydrogen) or hydrogen. The annealing temperature should preferably be within the range 620-650° C. It is desirable not to exceed a maximum temperature of 680° C. The annealing time for this temperature range is 30 to 45 minutes.

When brazing it should be noted that the addition of germanium lowers the melting temperature of the alloy by 59° F. (15° C.) relative to sterling silver. It is recommended that an "easy" or "extra easy" grade of solder should be used. The brazing temperature is preferably not more than 680° C., and preferably in the range 600-660° C. A low-melting solder (BAg-7) which may be used contains 56% silver, 22% copper, 17% zinc, and 5% tin. The BAg -7 solder (an international standard) melts at 1205° F. (652° C.). Solders containing germanium, which will give better tarnish protection are described in UK Patent Application 03 26927.1 filed 19 Nov. 2003, the contents of which are incorporated by reference. A suitable solder which melts in the range 600-650° C. comprises about 58 wt % Ag. 2 wt % Ge, 2.5 wt % Sn, 14.5 wt % Zn 0.1 wt % Si, 0.14 wt % B., and the balance Cu., a practically used variant of that solder having the analysis 58.15 wt % Ag, 1.51 wt Ge, 2.4 wt % Sn, 15.1 wt % Zn, 0.07 wt % Si, 0.14 wt % B, and the balance Cu.

Articles that are brazed by passage through a brazing furnace will, of course, have simultaneously been annealed. it has been found that precipitation hardening can develop without a quenching step by controlled gradual air-cooling in the downstream cooling region of the furnace. Articles which have been brazed in a furnace in this way, gradually cooled and then re-heated at 300° C. for 45 minutes have achieved hardness of 110-115 Vickers.

Compared to what is required for sterling silver, it will be noted that what is necessary for Argentium. sterling and other germanium-containing silver alloys involves a reduced number of processing steps with avoidance of quenching and only mild reheating to precipitation hardening to a required level.

Investment Cast Articles

Argentium casting grain is melted using traditional methods (solidus 766° C. liquidus 877° C.) and is cast at a temperature of 950-980° C. and at a flask temperature of not more than 676° C. under a protective atmosphere or with a protective boric acid flux. Flask temperatures during investment casting may be e.g. 500-700° C. and it has been found that sound castings are relatively insensitive to flask temperature. The investment material which is of relatively low thermal conductivity provides for slow cooling of the cast pieces.

Investment casting with air-cooling for 15-20 minutes followed by quenching of the investment flask in water after 15-20 minutes gives a cast piece having a Vickers hardness of about 70, which is approximately the same hardness as sterling silver. Surprisingly it has been found that a harder cast piece can be produced by allowing the flask to cool in air to room temperature, the piece when removed from the flask having a Vickers hardness of about 90. Most standard investment removers will successfully remove the investment powder, as will a pneumatic hammer whose vibration can break up the investment. A water-knife can also be used for removing the investment. The production by casting of pieces that combine this degree of hardness with firestain and tarnish resistance has not been reported.

Even more surprisingly, and contrary to experience with Sterling silver, where necessary, the hardness can be increased even further by precipitation hardening e.g. by placing the castings or the whole tree in an oven set to about 300° C. for 45 minutes to give heat-treated castings of approaching 125 Vickers.

In particular, as explained by Fischer-Buhner (supra) at p. 41, with conventional sterling silver simple slow cooling of flasks after casting results in growth of coarse Cu-rich precipitates and eliminates the possibility of precipitation hardening during a subsequent aging treatment. Water quenching is required within a narrow and critical range of times after casting, typically 4 minutes after casting, the hardening effect being reduced both by quenching too soon and too late. In the case of pieces cast on a tree different cooling conditions at different places on the tree prior to quenching result in the individual cast pieces differing in their ability to become hardened during the subsequent precipitation hardening step. All these problems of additional processing steps and control difficulties are avoided by the use of Ag—Cu—Ge alloys as described herein.

The invention will now be further described with reference to the following Examples.

EXAMPLES 1-8

The alloys indicated in the table below were prepared by melting together the listed constituents, and were subjected to the tests indicated below. Compositions where boron is indicated to be present are believed to contain about 4 ppm boron, but were not separately assayed. It will be noted that a very significant hardness increase was noted for the germanium-containing alloys, except where there was no copper content, in which case no hardening was observed. It is surprising that useful hardening of the initially very soft alloy of Example 4 was obtained.

TABLE 1

| Example No | Ag % | Zn % | Ge % | B | Cu % | Cooling method 1* HV | Cooling method 2* HV | Annealed hardness* HV |
|---|---|---|---|---|---|---|---|---|
| 1 | 95.44 | 0 | 1.5 | 4 ppm | Balance | 108 | 115 | 67 |
| 2** | 96 | 0 | 1.55 | Yes | Balance | 107 | 110 | 64 |
| 3** | 96 | 0 | 2 | Yes | Balance | 110 | 106 | 63 |
| 4** | 97.30 | 0 | 1 | Yes | Balance | 93 | 99 | 40 |
| 5** | 98.66 | 0 | 1.2 | Yes | 0 | 28 | 28 | 28 |
| | | | | | | No precipitation hardening | No precipitation hardening | |
| 6** | 95 | 1 | 1.5 | Yes | Balance | 109 | 114 | 74 |
| 7** | 93.2 | 0.7 | 1.3 | Yes | Balance | 113 | 117 | 56 |
| 8** | 92.7 | 2 | 1.3 | Yes | Balance | 113 | 117 | 72 |

*Cooling method 1—sample annealed at red heat (about 600° C.), air cooled, then heated at 300° C. for 45 minutes.
Cooling method 2—sample annealed at red heat (about 600° C.), quenched in water, then heated at 300° C. for 45 minutes.
Annealed hardness—sample annealed (about 600° C.), air cooled, no further heat treatment.
**No final assay results available. Table shows alloy make-up before melting.

EXAMPLES 9-10

Alloys of Examples 9 and 10 are prepared by melting with the following compositions:

| | Ex. 9 | Ex. 10 |
|---|---|---|
| Ag | 92.5 | 92.5 |
| Cu | 2.35 | 3.0 |
| Zn | 2.82 | 3.14 |
| Si | 0.19 | 0.15 |
| B | 0.01 | 0.01 |
| In | 0.23 | 0.2 |
| Ge | 1.9 | 1.0 |

The two alloys are cast and are tested for Vickers Hardness as cast and when annealed at red heat (about 600° C.), air cooled, then heated at 300° C. for 45 minutes. The hardness rises to over 100 Vickers alter the above described annealing and post-treatment without quenching.

EXAMPLES 11-12

Alloys of Examples 11 and 12 are prepared by melting with the following compositions:

| | Ex. 11 | Ex. 12 |
|---|---|---|
| Ag | 92.5 | 92.5 |
| Cu | 3.25 | 4.78 |
| Zn | 3.75 | 2.25 |
| Si | 0.2 | 0.2 |
| B | 0.01 | 0.01 |
| In | 0.25 | 0.075 |
| Ge | 0.04 | 0.125 |
| Sn | — | 0.075 |

The above alloys are cast and are tested for Vickers Hardness as cast and when annealed at red heat (about 600° C.), air cooled, then heated at 300° C. for 45 minutes. The hardness rises significantly after the above described annealing and post-treatment without quenching.

EXAMPLE 13

A master alloy is made by melting together 79 wt % Cu, 18 wt % Ge and 3 wt % of a Cu/B alloy containing 2 wt % boron. The Cu is melted together with the Cu/B master alloy. High temperatures can he used because there are no other elements to damage. The temperature is then lowered and the germanium is added just above the Ge inching point. Melting is therefore in descending order of melting temperatures i.e. copper/copper-boron master alloy/germanium. The resulting master alloy comprises, apart from impurities, and with a 50% boron loss on inching, about 82 wt % Cu, about 18 wt % Ge and about 0.03 wt % boron, together with an impurities.

There is then added 72 g of the above master alloy and 928 g of 9999 purity fine silver which when melted together just above the melting point of the fine silver (e.g. at about 960-1200° C.) with a 50% boron loss gives the desired silver/copper/germanium ternary alloy of composition about 92.8 wt % Ag. 5.90 wt % Cu, 1.30 wt. % Ge and about 11 ppm boron. The master alloy is weighed and placed in a crucible for melting and the fine silver is weighed and placed in the crucible, which is then heated to melt the silver and the master alloy under a protective cover of natural gas to prevent unnecessary oxidation. Silver has a known affinity for oxygen, which affinity increases with temperature. When exposed to air, molten silver will absorb about twenty-two times its volume of oxygen. Like silver, copper also has a great affinity for oxygen, typically forming copper oxide. Thus, forming or re-melting sterling silver and other silver-copper alloys, care must be taken to prevent oxidation. When the mixture becomes molten, it may be stirred e.g. with a carbon rod and poured through a tundish into water, so that the silver becomes solidified into shot-like granules or pellets of diameter about 3-6 mm which is the form in which sterling silver is typically sold.

The resulting alloy granules are used in investment casting using traditional methods and is cast at a temperature of 950-980° C. and at a flask temperature of not more than 676° C. under a protective atmosphere. The investment material which is of relatively low thermal conductivity provides for slow cooling of the cast pieces. Investment casting with air-cooling for 15-25 minutes followed by quenching of the investment flask in water after 15-25 minutes gives a cast piece having a Vickers hardness of about 70 which is approximately the same hardness as sterling silver. The products exhibit excellent tarnish and firestain resistance and have a fine grain structure due to their boron content. It has been found that a harder cast piece can be produced by allowing the flask to cool in air to room temperature, the piece when removed from the flask having a Vickers hardness of about 90-100 HV. Contrary to experience with Sterling silver, where necessary, the hardness can be increased even further by precipitation hardening, e.g. by placing castings or a whole tree in an oven set to about 300° C. for 20-45 minutes to give heat-treated castings of approaching 1250 HV. The germanium content is towards the upper limit of that presently considered desirable in a 0.925 type alloy.

As an alternative, the master alloy and fine silver in the form of granules can be mixed together in a crucible, and poured straight into the investment mould, giving similar results to those described above.

EXAMPLE 14

Alloys were prepared with the compositions and boron contents indicated in Table II below using CuB master alloys the source of boron.

TABLE II

| Sample ID | Ag % | Ge % | B ppm | Cu % | Precip. Hardened* (air-cooled) HV | Precip. Hardened* (quenched) HV | Annealed hardness (air-cooled) HV |
|---|---|---|---|---|---|---|---|
| 14.1 | 95.44 | 1.5 | 4 | 3.06 | 108 | 115 | 67 |
| 14.2** | 96 | 1.55 | Yes | 2.45 | 107 | 110 | 64 |
| 14.3** | 96 | 2 | Yes | 2 | 110 | 106 | 63 |
| 14.4** | 97.30 | 1 | Yes | 1.7 | 93 | 99 | 40 |
| 14.5** | 98.66 | 1.2 | Yes | 0.14 | 28*** | 28*** | 28*** |

*Precipitation hardening (air cooled)—sample annealed, air cooled, then heated at 300° C.; for 45 minutes. Precipitation hardening (quenched)—sample annealed, quenched, then heated at 300° C. for 45 minutes.
**No final assay results available. Table shows alloy make-up before melting.
***No precipitation hardening.

EXAMPLE 15

Zinc containing alloys according to the invention are prepared as set out in Table III below and their hardness is measured. In the above table, boron is added as CuB master alloy.

TABLE III

| Zinc alloys | Ag % | Ge % | B ppm | Cu % | Zn % | Precip. Hardened* (air-cooled) HV | Precip. Hardened* (quenched) HV | Annealed hardness (air-cooled) HV |
|---|---|---|---|---|---|---|---|---|
| 15.1** | 95 | 1.5 | 4-8 | 2.5 | 1 | 109 | 114 | 74 |
| 15.2** | 93.2 | 1.3 | 4-8 | 4.8 | 0.7 | 113 | 117 | 56 |
| 15.3** | 93.2 | 1.1 | 0 | 5.2 | 0.5 | 101 | 115 | 64 |
| 15.4** | 92.7 | 1.3 | 4-8 | 4 | 2 | 113 | 117 | 72 |

In the above, references to Vickers Hardness (HV) is understood in the US to be referred to as Diamond Pyramid Number (DPN).

What is claimed is:

1. A process for making a finished or semi-finished article of silver alloy, said process comprising the steps of:

providing a silver alloy containing silver in an amount of 92.5-95.44 wt %, copper and an amount of germanium that is at least 0.5 wt % and that is effective to reduce tarnishing and/or firestain;

making or processing the finished or semi-finished article of the alloy by heating at least to 600° C. for annealing and/or brazing or to a melting temperature;

gradually cooling the article over a period of at least 10 seconds; and reheating the article at 250-300° C. to effect precipitation hardening thereof and achieve an increase in hardness of 15 HV or more compared to the hardness of the alloy at the end of gradual cooling.

2. The process of claim 1, wherein the silver is melted, gradually cooled from molten and reheated to effect precipitation hardening.

3. The process of claim 1, wherein annealing and/or brazing is carried out at a temperature of from 600-650° C.

4. The process of claim 1, wherein germanium is present in the alloy in an amount of 0.8-1.5 wt %.

5. The process of claim 1, wherein 1-40 ppm boron is present in the alloy as grain refiner.

6. The process of claim 1, wherein the article is a ternary alloy of silver, copper and germanium further comprising a grain refiner.

7. The process of claim 6, wherein the alloy comprises, apart from impurities, incidental ingredients and any grain refiner, 92.5-95.44% silver, 0.5-3% germanium and 1-19.9% copper, by weight of the alloy.

8. The process of claim 1, wherein the alloy consists, apart from impurities, incidental ingredients and grain refiner, of 92.5-95.44% silver, 0.8-15% germanium, and 1-7.2% copper, by weight of the alloy, together with 1-40 ppm boron as grain refiner.

9. The process of claim 1, wherein the alloy is an Ag—Cu—Ge—Zn alloy containing boron as grain refiner.

10. The process of claim 1, wherein the alloy is an Ag—Cu—Ge—Si alloy containing boron as grain refiner, silicon being present in an amount of up to 0.2 wt %.

11. The process of claim 1, wherein the article is of jewellery or giftware.

* * * * *